PROCESS FOR DISSOLVING COAL IN HYDROCARBON MIXTURES

The invention relates to an improved process for bringing carbon-containing materials into solution by treatment of comminuted coal with very high-boiling mixtures of aromatic products and additions of low-boiling aromatic hydrocarbons, with application of elevated temperature and elevated pressure.

Owing to the long-term growing shortage of petroleum and natural gas, coal, of which there is an ample supply in many industrial countries, gains increasing importance as a raw material.

Besides, there is a growing tendency for converting heavy mineral oil fractions into petrol and light heating oil. This results in a large demand for technologies for putting into practice the production of substitute products for petroleum-derived residues, which are particularly suitable as raw materials for the production of organic products.

On coal basis, extraction processes have been proposed for a long time for the ash removal from, and liquefaction of, coal for producing products of this type.

In these processes, the coal is brought into intimate contact with a solvent under elevated pressure and at elevated temperature. The reaction product is separated from the high ash content residue and the low ash content coal extract can then be employed, after adjustment of suitable flow properties, (viscosity, softening point,) as a high quality raw material for the production of carbon products, e.g. electrodes or carbon fibers.

Particularly, hydrocarbon mixtures with available hydrogen are proposed as solvents for coal.

Such solvents as tetralin or hydrogenated authracene oil are capable of converting large proportions of the coal into the soluble form. In this connection, dissolution is usually given in the technical literature as the quinoline-soluble content of the coal employed, (G. O. Davies et al., J. Inst. Fuel, September 1977, page 121). According to this, when 3 parts of solvent and one part of coal are employed, with application of pressure and elevated temperature, according to the type of coal, up to 90% of the coal used can be converted into the quinoline-soluble form.

Technical processes of carbon hydrogenation or extraction, however, are preferably operated with lower oil/coal ratios. In addition, an oil/coal ratio of 2:1 is used for the hydrogenation processes.

The processes operating with hydrogenated aromatic products have the disadvantage, however, that, for the production of the hydrogenated aromatic products, an elaborate hydrogenation step has to be carried out before the actual coal extraction.

With other solvents, such as residues from the processing of mineral oil or the traditionally applied anthracene oil, extraction yields, as achieved with the hydrogenated aromatic product mixtures at the high pressures and temperatures, given in the literature, can only be attained if hydrogenation is additionally carried out with hydrogen.

Accordingly, the object of the present invention lies in providing an improved process for dissolving solid carbon-containing materials by the utilization of solvents having high solvating power, in order to obtain aromatic raw materials in high yields from these materials by extraction with solvents under particularly mild conditions of temperature and pressure and without hydrogenation. It is an object at the same time to widen the solvent basis for the purpose indicated.

According to the invention, this problem is solved by a process for bringing ground coal or similar carbon containing raw materials into solution with aromatic solvents under elevated pressure and at elevated temperature, characterized in that the solvents used are high-aromatic residues from the pyrolysis of petroleum fractions, having an average boiling point of above 380° C., and/or high-aromatic distillates from the pressure/-heat treatment of coal tar pitch, having an average boiling point of above 380° C., as well as from 5 to 30% of aromatic products or mixtures of aromatic products, having a boiling point of below 250° C.

In this process, comminuted coal is mashed with very high-boiling aromatic product mixtures, having an average boiling point >380° C., with addition of from 5 to 30% of low-boiling aromatic products and treated under elevated pressure and at increased temperature.

Preferred reaction conditions are temperatures around 340° C. and pressures around 10 bar.

The reaction product can be separated by known techniques, such as filtration, distillation or promoter-accelerated sedimentation, into a low-ash content coal extract, which is suitable for the production of carbon products, such as electrode coke, binders and carbon fibers, and a high-mineral content residue.

Adjustment of the flow properties of the reaction product is feasible, without difficulty, by means of aromatic product mixtures, derived from tar, such as, for example, wash oil or anthracene oil.

The type of coal can be varied across wide ranges, but coals having a relatively high volatile content, such as open-burning gas coal or free burning coals, are preferably employed as raw materials. These coals represent the largest part of all coal deposits; they are not very suitable for the production of metallurgical coke.

Low-volatile coals, such as lean coals, or other carbon containing raw materials, such as lignites or peat, however, are also eligible. The degree of comminution is of minor importance for this process.

The very high-boiling aromatic solvents, used according to the invention, are distillates from the further processing of coal tar pitch and/or from processes for the improvement of mineral oil residues, which arise, e.g. in the delayed coker or during the steam cracking of mineral oil fractions or in other catalytic or thermal cracking processes, (cf. e.g. West German Auslegeschrift No. 2,129,281 or U.S. Pat. No. 3,547,804). However, distillates, obtained during the heat/pressure treatment of coal tar pitch or during the coking of hard pitch, are particularly preferred.

Coal tar pitch accumulates in the primary distillation of coal tar, in a quantity of from 50 to 55%, having a softening point of from 65° to 75° C. (Krämer-Sarnow). Pitches, which soften in this temperature range, however, are not directly suitable for use as carbon intermediate products, such as electrode binders, hard pitch or pitch coke, but are improved for this purpose, according to known processes, by heat/pressure treatment, (cf. e.g. U.S. Pat. No. 2,985,577).

The distillates, accumulating in these processes, are high-boiling hydrocarbon mixtures of high aromatic content. These hydrocarbon mixtures have an average boiling point >380° C. and thus boil clearly above the anthracene oil fractions, which are usually recommended for coal extraction.

United States Patent [19]

Stadelhofer et al.

[11] 4,430,193

[45] Feb. 7, 1984

[54] PROCESS FOR DISSOLVING COAL IN HYDROCARBON MIXTURES

[75] Inventors: Jürgen Stadelhofer, Dortmund; Heinz-Gerhard Franck, Bad Soden-Neuenhain, both of Fed. Rep. of Germany

[73] Assignee: Rütgerswerke Aktiengesellschaft, Frankfurt am Main, Fed. Rep. of Germany

[21] Appl. No.: 283,869

[22] Filed: Jul. 16, 1981

[30] Foreign Application Priority Data

Aug. 14, 1980 [DE] Fed. Rep. of Germany ..... 3030723

[51] Int. Cl.[3] ..... C10G 1/00

[52] U.S. Cl. ..... 208/8 LE; 208/23

[58] Field of Search ..... 208/8 LE, 23

[56] References Cited

U.S. PATENT DOCUMENTS

| | | | |
|---|---|---|---|
| 2,985,577 | 5/1961 | Geller et al. | 208/6 |
| 3,705,092 | 12/1972 | Gatsis | 208/8 LE |
| 3,870,621 | 3/1975 | Arnold et al. | 208/8 LE |
| 3,966,585 | 6/1976 | Gray et al. | 208/8 LE |
| 4,040,941 | 8/1977 | Yamado et al. | 208/8 LE |
| 4,054,504 | 10/1977 | Chervenok et al. | 208/10 |
| 4,108,758 | 8/1978 | Schoennogel et al. | 208/8 LE |
| 4,111,786 | 9/1978 | Sugimura et al. | 208/8 LE |
| 4,221,654 | 9/1980 | Stein et al. | 208/8 LE |
| 4,251,345 | 2/1981 | Ogura et al. | 208/8 LE |
| 4,339,328 | 7/1982 | Stadelhofer et al. | 208/23 X |

*Primary Examiner*—William G. Wright

*Attorney, Agent, or Firm*—Beveridge, DeGrandi & Kline

[57] ABSTRACT

A process is described for bringing ground coal or similar carbon-containing raw materials into solution with aromatic solvents under elevated pressure and at elevated temperature. The solvents used are high-aromatic residues obtained from the pyrolysis of petroleum fractions, having an average boiling point of above 380° C., and/or high-aromatic distillates from the pressure/heat treatment of coal tar pitch, having an average boiling point of above 380° C., as well as from 5 to 30% of aromatic products or mixtures of aromatic products, having a boiling point of below 250° C.

3 Claims, No Drawings

TABLE

REACTION COMPONENTS AND PRODUCT CHARACTERIZATION

| Reaction Components | Product Characterization: softening point (K.-S.) | QI [%] | degree of carbon solubilization [%] |
|---|---|---|---|
| Example 1: 35 parts by weight of Westerholt coal, 13 parts by weight of mesitylene, 52 parts by weight of pitch distillate | 80° C. | 8.8 | 79 |
| Example 2: 35 parts by weight of Westerholt coal, 13 parts by weight of indane fraction, 52 parts by weight of pitch distillate | 82° C. | 8.8 | 79 |
| Example 3: 35 parts by weight of Westerholt coal, 13 parts by weight of acenaphthene fraction, 52 parts by weight of pitch distillate | 80° C. | 10.2 | 75 |
| Example 4: 35 parts by weight of Westerholt coal, 65 parts by weight of pitch distillate | 82° C. | 14.6 | 61 |

QI: quinoline-insoluble content

We claim:

1. In a process for bringing ground coal or similar carbon-containing raw materials into solution with aromatic solvents under elevated pressure and at elevated temperature, the improvement wherein the solvents used are high-aromatic residues from the pyrolysis of petroleum fractions, having an average boiling point of above 380° C., and/or high-aromatic distillates from the pressure/heat treatment of coal tar pitch, having an average boiling point of above 380° C., as well as from 5 to 30% of aromatic products or mixtures of aromatic products, having a boiling point of below 250° C.; said process being carried out without hydrogenation, at temperatures of from 250° to 360° C.

2. The process according to claim 1, wherein solvent mixture, having an average boiling point of above 380° C., and aromatic products, having a boiling point of below 250° C., and finely ground coal are mixed with one another at the ratio of from 1.5:1 to 2.5:1 and reacted under a pressure of between 3 and 20 bar for from 0.5 to 5 hours.

3. The process according to claims 1 or 2, wherein the low-boiling aromatic products or mixtures of aromatic products used are those boiling within the range of from 130° to 200° C.

* * * * *